US010923836B2

(12) United States Patent
Youtsey

(10) Patent No.: US 10,923,836 B2
(45) Date of Patent: Feb. 16, 2021

(54) DEFORMABLE RADIO FREQUENCY INTERFERENCE SHIELD

(71) Applicant: PCT International, Inc., Tempe, AZ (US)

(72) Inventor: Timothy L. Youtsey, Tempe, AZ (US)

(73) Assignee: PCT International, Inc., Tempe, AZ (US)

( * ) Notice: Subject to any disclaimer, the term of this patent is extended or adjusted under 35 U.S.C. 154(b) by 0 days.

(21) Appl. No.: 16/847,513

(22) Filed: Apr. 13, 2020

(65) Prior Publication Data

US 2020/0243987 A1 Jul. 30, 2020

Related U.S. Application Data

(63) Continuation of application No. 16/409,626, filed on May 10, 2019, now Pat. No. 10,622,732.

(60) Provisional application No. 62/669,972, filed on May 10, 2018.

(51) Int. Cl.

| | |
|---|---|
| ***H01R 13/625*** | (2006.01) |
| ***H01R 9/05*** | (2006.01) |
| ***H01B 11/10*** | (2006.01) |
| ***H01R 13/6581*** | (2011.01) |
| ***H01R 24/48*** | (2011.01) |

(52) U.S. Cl.

CPC ..... *H01R 9/0503* (2013.01); *H01B 11/10* (2013.01); *H01R 13/6581* (2013.01); *H01R 24/48* (2013.01)

(58) Field of Classification Search

CPC ..... H01R 13/6275; H01R 13/639; H01R 13/62933; H01R 23/7005

USPC ..... 439/345, 953, 378, 372

See application file for complete search history.

(56) References Cited

U.S. PATENT DOCUMENTS

2005/0106909 A1* 5/2005 Dickie ..... H01R 13/4538 439/134

* cited by examiner

*Primary Examiner* — Phuong Chi Thi Nguyen

(74) *Attorney, Agent, or Firm* — Thomas W. Galvani, P.C.; Thomas W. Galvani

(57) ABSTRACT

A deformable shield for mitigating radio frequency interference with a male coaxial connector includes a flexible hollow body having opposed front and rear ends, a concave section of the body proximate the front end, defining an open mouth of the shield configured to receive a female coaxial port, and a bellows section of the body behind the concave section. The bellows section terminates at the rear end with another mouth configured to be fit upon the male coaxial connector.

14 Claims, 7 Drawing Sheets

DEFORMABLE RADIO FREQUENCY INTERFERENCE SHIELD

CROSS-REFERENCE TO RELATED APPLICATIONS

This application is a continuation of and claims the benefit of prior U.S. patent application Ser. No. 16/409,626, filed May 10, 2019, which claims the benefit of U.S. Provisional Application No. 62/669,972, filed May 10, 2018, all of which are hereby incorporated by reference.

FIELD OF THE INVENTION

The present invention relates generally to telecommunications, and more particularly to radio frequency communication devices.

BACKGROUND OF THE INVENTION

Cable and telecommunication installations face a number of challenges. One that cannot always be controlled, even by a professional installer, is noise. Noise ingress into a system can reduce signal quality and system performance, especially if signal-to-noise ratios are low.

One source of noise ingress is from other RF signals and devices in the environment. Efforts to minimize noise ingress have been made in many products, such as connectors and cables. However, the effectiveness of these efforts can be hampered. For example, if a homeowner disconnects a cable without proper termination, RF noise can enter the system through the end of that cable. Systems and methods for mitigating noise in telecommunication systems are needed.

SUMMARY OF THE INVENTION

A deformable shield for mitigating radio frequency interference with a male coaxial connector includes a flexible hollow body having opposed front and rear ends, a concave section of the body proximate the front end, defining an open mouth of the shield configured to receive a female coaxial port, and a bellows section of the body behind the concave section. The bellows section terminates at the rear end with another mouth configured to be fit upon the male coaxial connector.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
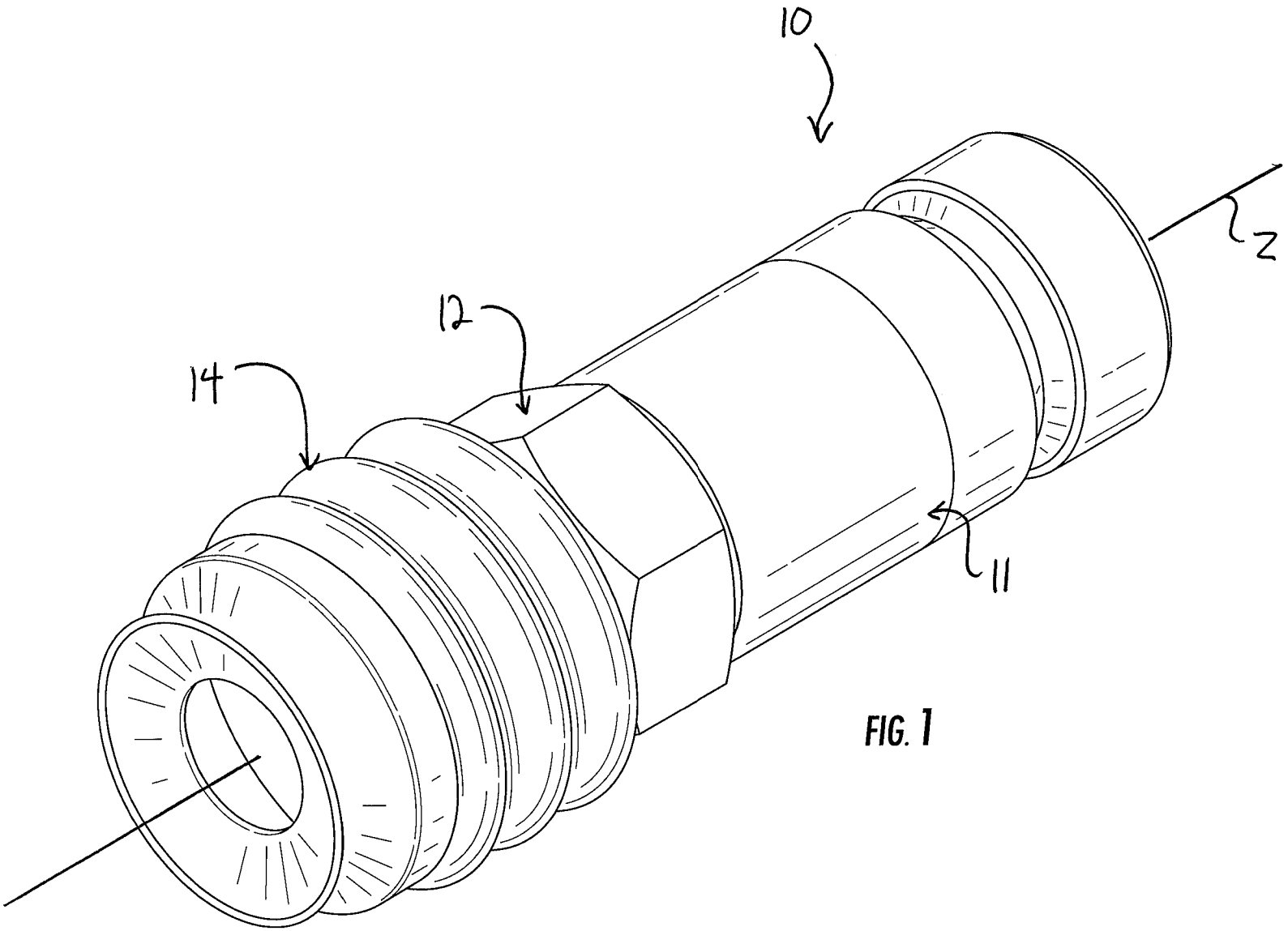
FIG. 1 is a perspective view of a coaxial cable connector fit with a deformable radio frequency interference shield.
Figure 2:
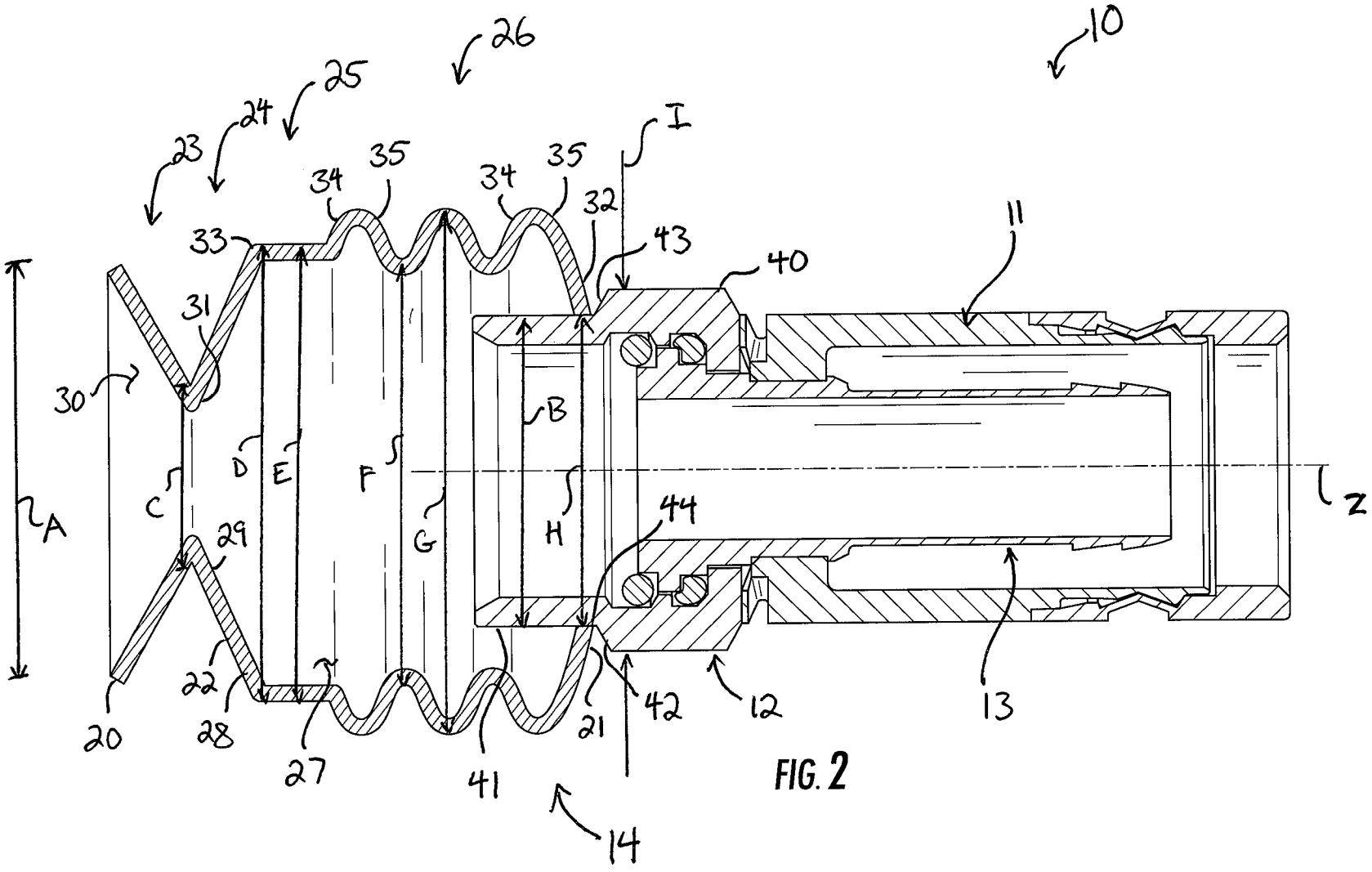
FIG. 2 is a section view taken along the line 2-2 in FIG. 1 showing the deformable radio frequency interference shield in a neutral condition.
Figure 6:
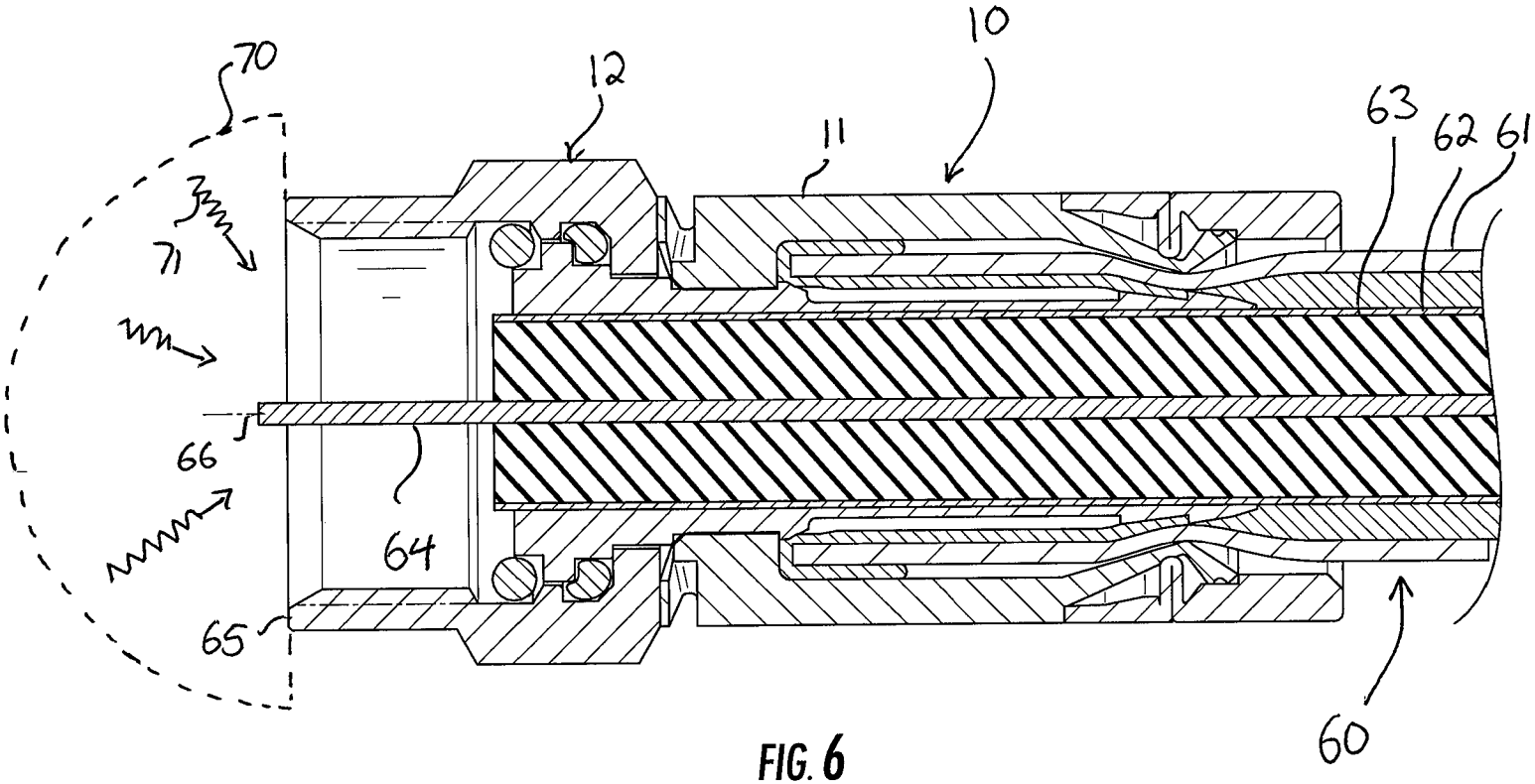
FIGS. 6 and 7 show the coaxial cable connector of FIG. 1 with and without the deformable radio frequency interference shield and illustrate the effectiveness of the shield at mitigating radio frequency interference.
Figure 7:
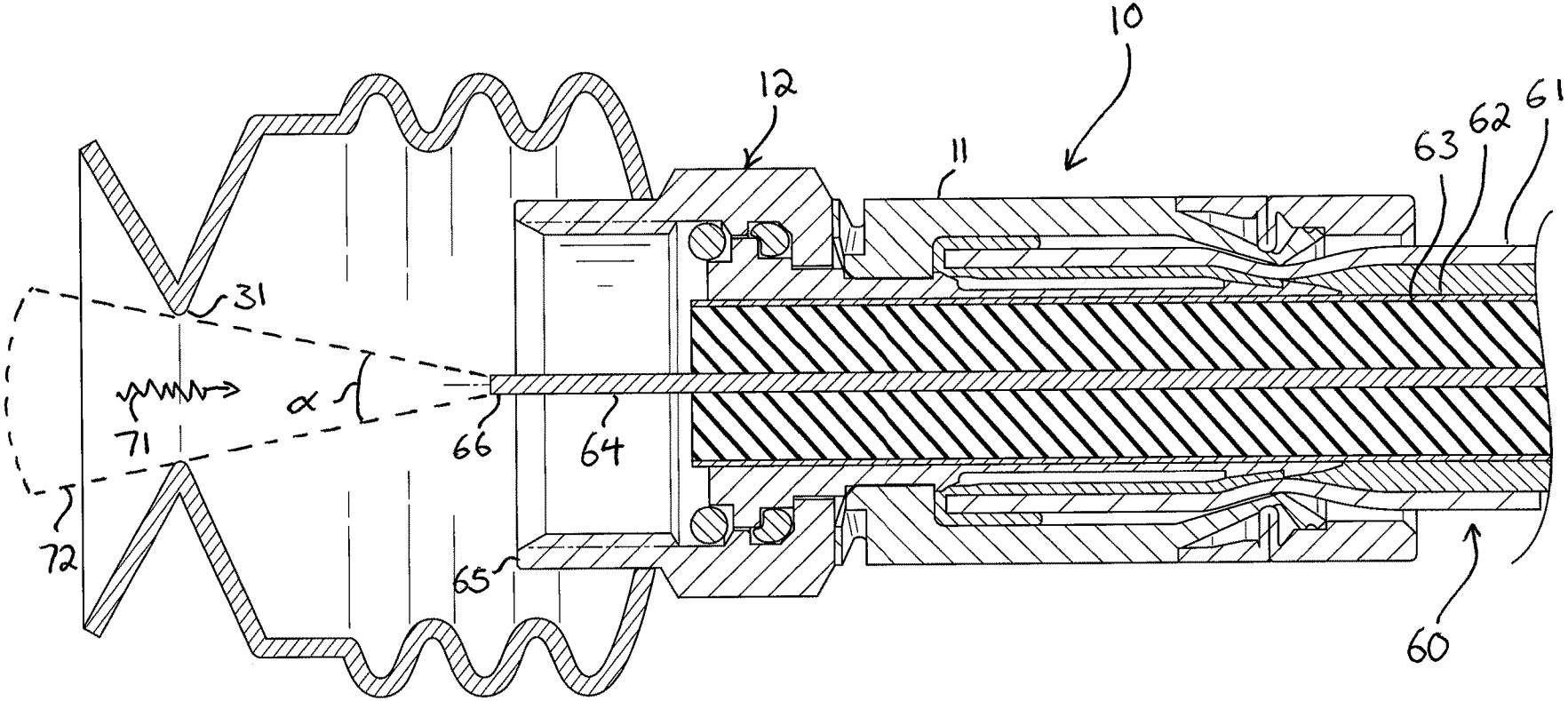

Reference now is made to the drawings, in which the same reference characters are used throughout the different figures to designate the same elements. FIG. 1 is a perspective view and FIG. 2 is a section view taken along the line 2-2 in FIG. 1, both showing a coaxial cable connector 10 including a body 11, a coupling 12 at the front of the body 11, and an inner post 13 (shown only in FIG. 2) on which both the body 11 and coupling 12 are mounted. A deformable radio frequency interference shield 14 (hereinafter, "shield 14") is carried on the connector 10 at the coupling 12. The shield 14 prevents ingress of radio frequency interference ("RFI") to the connector 10 and its center conductor when the connector 10 is uncoupled from an electronic component, it prevents ingress of RFI while the connector 10 is fully applied to an electronic component or during partial or loosened application of the connector 10 on an electronic component, and it also prevents egress of RFI out of the connector 10 to other electronic devices and components when the connector 10 is free and unapplied to any device. RFI which reaches the center conductor of a coaxial cable applied to the connector 10, or which reaches the internal components within the connector 10, can negatively affect the quality of the signal transmitted in a cable to which the connector 10 is attached. The shield 14 is effective at preventing the transmission of RFI to and from the center conductor and the internal components; FIGS. 6 and 7 illustrate the connector 10 without and with the shield 14 and illustrate the effectiveness of the shield 14 at mitigating RFI.

The shield 14 is constructed of a flexible, resilient material or combination of materials to allow it to mold and deform in response to application over a coupling nut 12, a female coaxial port, or another part of an electronic component. The shield 14 includes a front end 20, an opposed rear end 21, and a body 22 extending therebetween. The body 22 is substantially cylindrical, having sections of different profiles, but each of which is substantially similar. A concave conical section 23 is at the front end 20, with a convex conical section 24 behind it. It is noted here that the terms "concave" and "convex" are made with respect from a perspective in front of the connector 10. From the convex conical section 24, a short cylindrical section 25 extends rearwardly, and just behind that is a boot or bellows section 26. Each of these sections bounds and defines an interior 27 extending axially and entirely throughout the shield 14 from the front end 20 to the rear end 21. Briefly, "axially" is meant to include along or parallel to an axis Z extending through the connector 10 and the shield 14. The sections are integrally formed to each other as a common sidewall 28, and the sidewall 28 acquires different profiles in each of the sections. The sidewall 28 has an inner surface 29 bounding the interior 27 along the full axial length of the shield 14.

Figure 3:
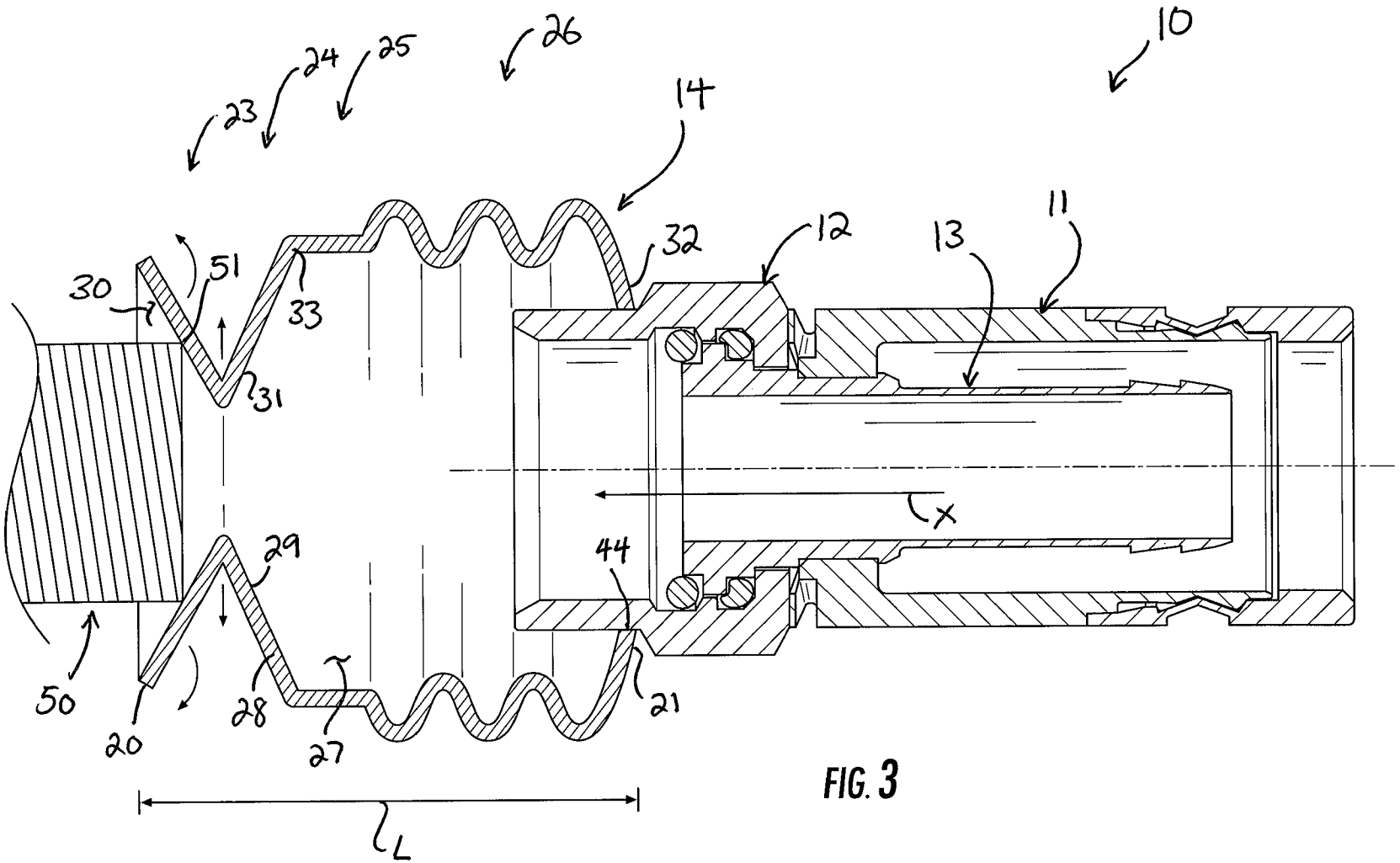
FIGS. 3 and 4 are section views taken along the line 2-2 in FIG. 1 showing the deformable radio frequency interference shield in neutral and deformed conditions, respectively, in response to application of the coaxial cable connector toward a female coaxial port.
Figure 4:
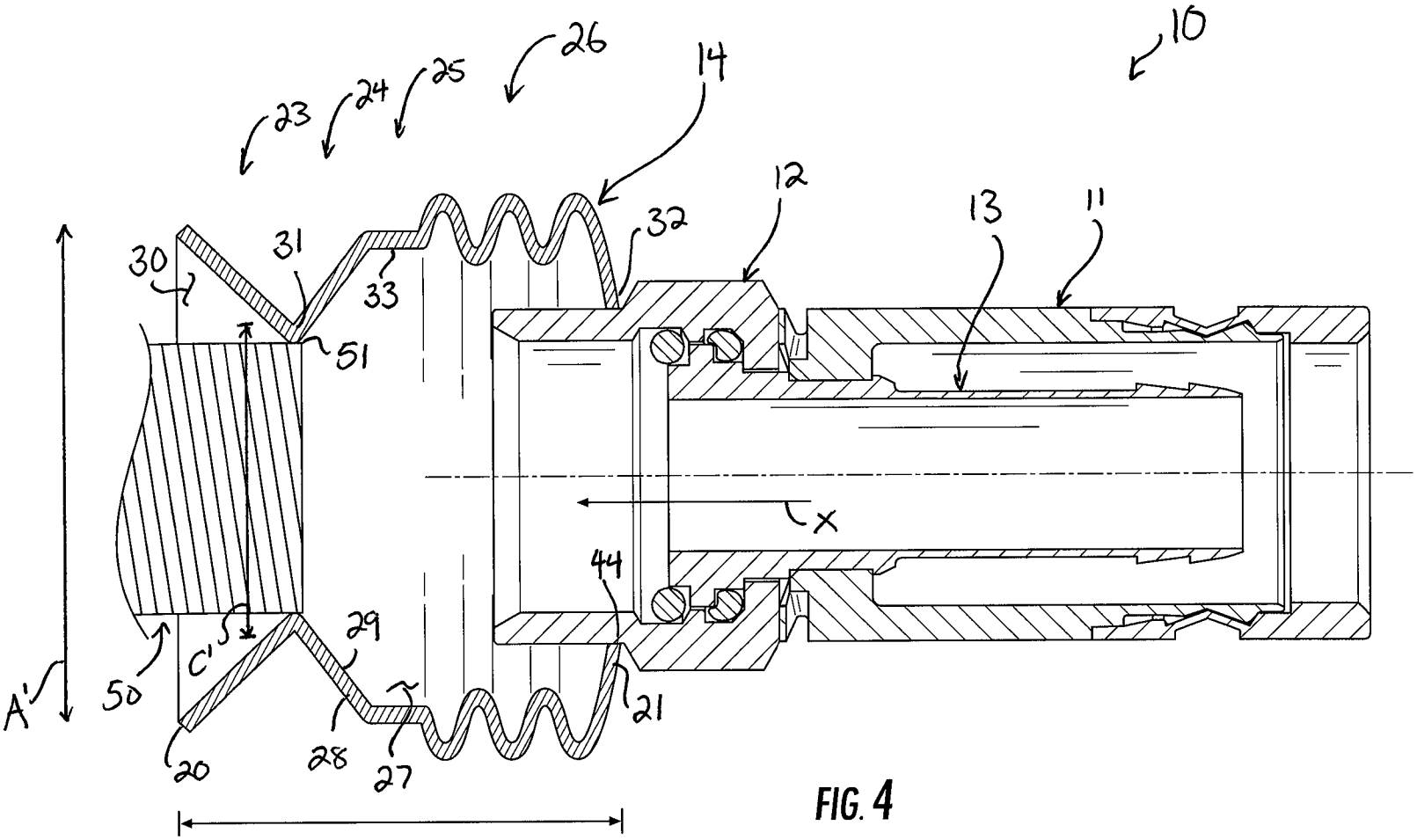

At the front end 20 of the shield 14, the concave conical section 23 terminates forwardly in an open mouth 30. The mouth 30 defines a front end of the concave conical section 23. The mouth 30 is wide, generally circular, and defines an entrance to the interior 27. The mouth 30—and indeed the entire shield 14—flexes and deforms in response to application of a female coaxial port into and through the shield 14 toward the connector 10. The shield 14 moves from a neutral condition, as shown in FIGS. 2 and 3, to a deformed condition, as shown in FIG. 4.

When the shield 14 is in the neutral condition, the sidewall 28 has a large outer diameter A at the mouth 30, which is approximately one-and-a-half times larger than an outer diameter B of the coupling nut 12 on the connector 10. The sidewall 28 tapers inwardly and rearwardly to a constriction point 31. The constriction point 31 is an annular point in the shield 14 defining the narrowest diameter of the shield 14. The outer diameter C of the shield 14 at the constriction point is approximately half the outer diameter A of the coupling nut 12 on the connector 10. The constriction point 31 defines a rear end of the concave conical section 23 and a significant constriction on the interior 27 with respect to the mouth 30. The concave conical section 23 deflects and deforms axially in response to introduction of a female coaxial port, while simultaneously deflecting and deforming radially inwardly and outwardly, as described in more detail. This provides the shield 14 with the ability to accommodate introduction of a female coaxial port.

From the constriction point 31, the sidewall 28 extends radially outwardly and rearwardly to a hinge point 33, thus forming the convex conical section 24. This opens the interior 27 considerably behind the constriction point 31. The sidewall 28 extends radially outward to an outer diameter D which is just larger than the outer diameter A at the mouth 30 of the shield 14. The convex conical section 24 deflects and deforms radially outward and also axially in response to introduction of a female coaxial port, thereby providing the shield 14 with the ability to deform radially and axially and to accommodate introduction of a female coaxial port.

From the convex conical section 24, which terminates at the hinge point 33, the sidewall 28 then extends rearwardly, parallel to the axis of the shield 14 a short distance, forming the cylindrical section 25. The cylindrical section 25 has a constant outer diameter E, which is equal to the outer diameter D of the convex conical section 24 at its hinge point 33.

The bellows section 26 is disposed at the rear end 21 of the shield 14. The sidewall 28 here is shaped into a series of alternating convex annular portions 34 and concave annular portions 35 extending from a series of outer diameters F and inner diameters G. The bellows section 26 yields and deforms axially in response to introduction of a female coaxial port, providing the shield 14 with the ability to deform axially and to accommodate introduction of a female coaxial port. The bellows section 26 terminates at the rear end 21 with a mouth 32. The mouth 32 has an inner diameter H, which is reduced with respect to the convex and concave portions F and G of the bellows section 26, is reduced with respect to the outer diameter E of the cylindrical section 25, but is larger than the outer diameter C of the constriction point 31. The mouth 32 is fit over, and forms a continuous seal against, the coupling nut 12.

The coupling nut 12 has a rear hexagonal portion 40 and a forward ring portion 41. The hexagonal portion 40 has a larger outer diameter than the ring portion 41, and thus there is a shoulder 42 formed therebetween. The shoulder 42 presents a raised front face 43. An outer diameter I of the shoulder 42 is greater than the inner diameter H of the mouth 32 of the bellows section 26 and, as such, the mouth 32 is prevented from moving backward over the shoulder 42 or onto the hexagonal portion 40. Therefore, the mouth 32 is retained in contact along the ring portion 41 against raised front face 43. Other embodiments may have an annular groove into which the mouth 32 is seated or another retaining structure; the structure of the connector 10 described herein is not limiting. Because the mouth 32 is circular and the raised front face 43 is circular or nearly circular, the mouth 32 forms a continuous seal 44 with the coupling nut 12 at the shoulder 42. This seal 44 provides audible feedback when the shield 14 is used, as will be explained.

Moreover, the outer diameter I of the coupling nut 12 is greater than the outer diameter C of the constriction point 31. This limits the amount of RFI that can enter the interior 27, and thus, when used in this manner, the shield 14 mitigates the effects of RFI at the connector 10.

In FIGS. 3 and 4, the shield 14 is shown in use on the connector 10. The shield 14 is fit onto the coupling nut 12, and the connector 10 is ready for application onto a female coaxial port 50 of an electronic component (such as a coaxial coupler, a set-top box, a DVR device, a MoCA device, or other similar coaxial component). The connector 10 is typically applied to the female coaxial port 50 in a conventional manner, such as by pushing the coupling onto or over the female coaxial port 50 or by threadably engaging threads formed on the inside of the coupling nut 12 with threads formed on the outside of the female coaxial port 50. In this case, no threads are shown on the inside of the coupling nut 12, and the connector 10 can be considered a push-on style of connector. Indeed, the connector 10 is exemplary of connectors with which the shield 14 can be used; the shield 14 can be used with any connector preferably having a coupling nut, having a front with a shoulder 42, or having a front that will accept the mouth 32.

In FIG. 3, the connector 10 is brought into close proximity with the female coaxial port 50. The female coaxial port 50 has been advanced axially past the mouth 30 and just makes contact with the inner surface 29 of the sidewall 28 at the concave conical section 23. As such, the female coaxial port 50 contacts but exerts no bias on the shield 14. The shield 14 is therefore in its neutral condition, in which it is not compressed, not deformed, and not under any stress or force. The shield 14 has an axial length L.

The connector 10 is moved in the direction along the arrowed line X toward the female coaxial port 50. As is conventional, the connector 10 must be advanced forwardly to be applied onto the female coaxial port 50, because typically the female coaxial port 50 is part of a larger electronic component (such as a DVR or cable box) or is mounted in a plate in a wall and is therefore stationary. When the shield 14 is used, the female coaxial port 50 must first be introduced to and applied through the shield 14 before the connector 10 can be applied onto the female coaxial port 50. As such, the connector 10 is moved forward to deform the shield 14 from its neutral condition of FIG. 3 to its deformed condition of FIG. 4 before application of the female coaxial port 50 into the connector 10.

Forward movement of the connector 10 along line X brings a front edge 51 of the female coaxial port 50 into contact with the inner surface 29 of the sidewall 28 of the concave conical section 23, just beyond and within the mouth 30. The front edge 51 exerts a radially-outward and axially-rearward force or bias against the concave conical section 23, urging it along the arcuate arrowed lines in FIG. 3; the direction of this urging has both a radially outward component and an axially rearward component.

In response, the concave conical section 23 moves around the female coaxial port 50, as shown in FIG. 4. This causes the outer diameter C of the constriction point 31 to enlarge, moving radially outwardly along the short, straight arrowed lines in FIG. 3, to a new outer diameter C'. This, in turn, causes the convex conical section 24 to elongate and orient more closely with the cylindrical section 25, as in FIG. 4. Both the concave and convex conical sections 23 and 24 thus pivot or hinge; the concave conical section 23 hinges forward about the constriction point 31, and the convex conical section 24 hinges forward about the hinge point 33. This hinging action causes the mouth 30 to close slightly, defining the mouth 30 with a new outer diameter A' (FIG. 4) which is smaller than the outer diameter A of the mouth 30 in the neutral condition. It also causes both the concave conical section 23 and the convex conical section 24 to enlarge axially, or increase in their axial lengths.

Moving the connector 10 forward with the shield 14 applied thereon imparts an axially-rearward force on the shield 14. As explained above, this causes the concave and convex conical sections 23 and 24 to pivot and slide over the female coaxial port 50, as shown in FIG. 4. The short cylindrical section 25, aligned parallel to the direction of the force on the shield 14, yields very little. However, the bellows section 26 deforms.

The bellows section 26 is prevented from rearward movement by the shoulder 42, over which the smaller-diameter mouth cannot move. As such, when the axially-rearward force is applied to the shield 14, the front of the bellows section 26 moves, and so the bellows section 26 yields and deforms axially.

FIG. 4 shows the bellows section 26 deforming. The convex and concave portions 34 and 35 each deform and axially compress, axially compressing or shortening the bellows section 26. The mouth 32 maintains its position on the coupling nut 12. When the shield 14 is compressed into the deformed condition, the interior 27 volume is reduced. The mouth 32 on the coupling nut 12 forms a continuous seal, and the mouth 30 on the female coaxial port 50 forms a continuous seal. As such, air trapped in the decreasing volume of the interior 27 must escape. When it escapes out of the mouth 30 or mouth 32, it makes a popping, or burping, sound. This provides audible feedback to the user to confirm proper application and movement of the connector 10 with respect to the female coaxial port 50. In some embodiments, petroleum jelly or another lubricant may be applied to the shield 14. This improves the lifespan of the shield 14, especially in hazardous environments, and also generally increases the volume of the burp.

With pivoting movement of the concave and convex conical sections 23 and 24 and deformation and compression of the bellows section 26, the axial length L of the shield 14 decreases to the length L' shown in FIG. 4. In FIG. 4, the female coaxial port 50 is shown disposed in the constriction point 31. Further movement of the connector 10 forward along the arrowed line X moves the female coaxial port 50 further through the shield 14, closer to the coupling nut 12. The shield 14 moves over the female coaxial port 50 and past the front edge 51, with the cylindrical section 25 and the bellows section 26 eventually moving over the female coaxial port 50 until the female coaxial port 50 is in contact with the coupling nut 12. The coupling nut 12 is applied the female coaxial port 50, either in a push-on fashion (as in this embodiment) or with a threaded engagement (as in other embodiments). With the coupling nut 12 so applied to the female coaxial port 50, the shield 14 forms a cover overlapping both the coupling nut 12 and the female coaxial port 50, insulating both from RFI.

To remove the connector 10, the coupling nut 12 is simply unthreaded from or pulled off the female coaxial port 50 in a direction opposite to the arrowed line X. This disengages the connector 10 from the female coaxial port 50. When the connector 10 is free of the female coaxial port 50, the shield 14 returns to its original position of the neutral condition, with a narrow-diameter constriction point 31. As such, the shield 14 protects the connector 10 from RFI when the connector 10 is unapplied to any electronic component.

To illustrate the effectiveness of the shield 14, FIGS. 6 and 7 show the connector 10 in two different states. In FIG. 7, the connector 10 carries the shield 14, while in FIG. 6, the connector 10 is bare and does not have the shield 14. A coaxial cable 60 has been applied to the connector 10 in each drawing. The cable 60 is a conventional cable, including a jacket 61, foil layer 62, dielectric 63, and center conductor 64. The center conductor 64 extends through the body 11 of the connector and extends beyond the coupling nut 12. The coupling nut 65 has a front end 65. The center conductor 64 also has a front end 66 which extends just beyond the front end 65 of the coupling nut 12. When a homeowner connects one end of a cable 60 such as this to an electronic component and leaves this end fit with a connector 10 but unterminated, uncoupled to any device, RFI will enter the center conductor 64, and transmit through the cable 60 to the electronic component to which the end of the cable 60 is coupled. This introduces noise to the electronic component and will degrade its performance.

As can be seen in FIG. 6, when the connector 10 does not have the shield 14 installed, RFI may enter the center conductor from a wide range of angles. RFI 71 may communicate toward the center conductor 64 from a semi-spherical space 70, marked with a broken line, surrounding the center conductor 64. This space 70 extends entirely around the center conductor 64 and is bound by the front end 65 of the coupling nut 12 only.

When fit with the shield 14, however, the connector 10 protects the center conductor 64 from RFI ingress. As shown in FIG. 7, the space 70 has been reduced to a narrow cone 72 (again shown in broken line). The narrow diameter of the constriction point 31 limits the size of the cone 72. Rather than 180 degree angle of the space 70, this cone 72 has a small angle $\alpha$, which is approximately twenty to thirty degrees. Thus, the space from which RFI 71 may communicate toward the center conductor 64 is dramatically reduced. Approximately eighty-five percent of the RFI is eliminated with the cone 72 versus the space 70.

Figure 5:
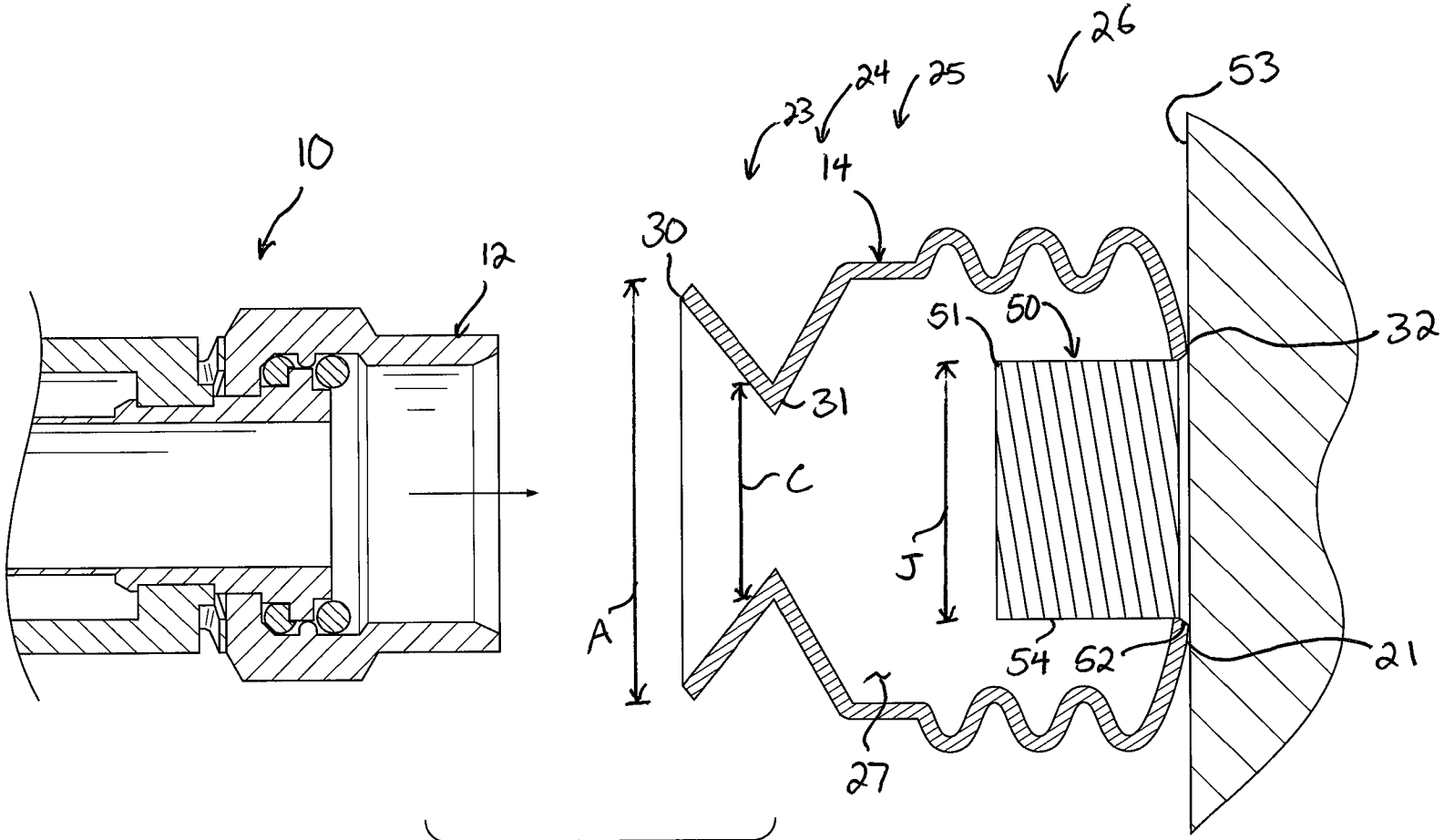
FIG. 5 is a section view of the deformable radio frequency interference shield fit onto a female coaxial port, with a coaxial cable connector being advanced thereto.

FIG. 5 illustrates an alternate installation of the shield 14. While FIGS. 1-4 show the shield 14 in use on a connector 10, the shield 14 is also suitable for use on the female coaxial port 50. The shield 14 shown in FIG. 5 is identical to the shield shown in FIGS. 1-4, and as such, not all of the structural elements and features are repeated in the below description, as one having ordinary skill in the art will readily understand the structure of the shield 14 in FIG. 5 from the description made in reference to FIGS. 1-4. The shield 14 has the concave conical section 23, the convex conical section 24, the short cylindrical section 25, the bellows section 26, an interior 27, mouths 30 and 32, a constriction point 31, as well as outer diameters A and C.

The rear end 21 of the shield 14 is fit to a body 54 of the female coaxial port 50. Specifically, the mouth 32 of the shield 14 is sealed around the base 52 of the female coaxial port 50 near the wall 53, and the bellows section 26 projects forwardly over the female coaxial port 50 and past the front edge 51. The outer diameter A of the mouth 30 is greater than an outer diameter J of the body 54 of the female coaxial port 50. The cylindrical section 26, the convex conical section 24, and the concave conical section 23 are all in front of the front edge 51 of the female coaxial port 50. As such, the constriction point 31 is axially spaced apart from the front edge 51 of the female coaxial port 50, and the outer diameter C of the constriction point 31 is smaller than the outer diameter J of the body 54 of the female coaxial port 50. This limits the amount of RFI that can enter the interior 27, and thus, when used in this manner, the shield 14 mitigates the effects of RFI at the female coaxial port 50, thereby improving the performance of the electronic component of which the female coaxial port 50 is part.

Moreover, a connector 10 may later be applied to the female coaxial port 50 by moving the connector 10 onto the female coaxial port 50 in a similar fashion as described above, though with the shield 14 now accommodating the connector 10. When the coupling nut 12 is moved toward and into the shield 14, the coupling nut 12 deforms the shield 14 as described above. The connector 10 is applied onto the female coaxial port 50 as described above, the shield 14 overlaps both the coupling nut 12 and the female coaxial port 50, thereby insulating both from RFI.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A deformable shield for mitigating radio frequency interference with a male coaxial connector, the shield comprising:

a flexible hollow body having opposed front and rear ends;

a concave section of the body proximate the front end, defining an open mouth of the shield configured to receive a female coaxial port;

a bellows section of the body behind the concave section, the bellows section terminating at the rear end with another mouth configured to be fit upon the male coaxial connector; and a constriction point between the concave section and the bellows section, wherein the constriction point has an outer diameter which is greater than an outer diameter of the outer mouth at the rear end of the body.

2. The deformable shield of claim 1, wherein, when applied to the male coaxial connector, the shield produces audible feedback in response to application of a female coaxial port through the open mouth at the front end of the shield.

3. The deformable shield of claim 1, wherein the outer diameter of the constriction point increases in response to application of a female coaxial port through the open mouth at the front end of the shield.

4. The deformable shield of claim 1, wherein the concave section deforms in response to application of a female coaxial port through the open mouth at the front end of the shield.

5. The deformable shield of claim 4, wherein the concave section deforms in response to application of the female coaxial port by enlarging axially.

6. The deformable shield of claim 1, wherein the bellows section deforms in response to application of a female coaxial port through the open mouth at the front end of the shield and toward the other mouth at the rear end of the shield.

7. The deformable shield of claim 6, wherein the bellows section deforms in response to application of the female coaxial port by compressing axially.

8. A deformable shield for mitigating radio frequency interference with a female coaxial port, the shield comprising:

a flexible hollow body having opposed front and rear ends;

a concave section of the body proximate the front end, defining an open mouth of the shield configured to receive a male coaxial connector;

a bellows section of the body behind the concave section, the bellows section terminating at the rear end with another mouth configured to be fit upon the female coaxial port; and a constriction point between the concave section and the bellows section, wherein the constriction point has an outer diameter which is greater than an outer diameter of the other mouth at the rear end of the body.

9. The deformable shield of claim 8, wherein, when applied to the female coaxial port, the shield produces audible feedback in response to application of a male coaxial connector through the open mouth at the front end of the shield.

10. The deformable shield of claim 8, wherein the outer diameter of the constriction point increases in response to application of a male coaxial connector through the open mouth at the front end of the shield.

11. The deformable shield of claim 8, wherein the concave section deforms in response to application of a male coaxial connector through the open mouth at the front end of the shield.

12. The deformable shield of claim 11, wherein the concave section deforms in response to application of the male coaxial connector by enlarging axially.

13. The deformable shield of claim 8, wherein the bellows section deforms in response to application of a male coaxial connector through the open mouth at the front end of the shield and toward the other mouth at the rear end of the shield.

14. The deformable shield of claim 13, wherein the bellows section deforms in response to application of the male coaxial connector by compressing axially.

* * * * *